US005732488A

United States Patent [19]

Smith

[11] Patent Number: 5,732,488

[45] Date of Patent: Mar. 31, 1998

[54] QUICK HITCH ASSEMBLY

[75] Inventor: Norman John Smith, Narangba, Australia

[73] Assignee: Ephemere Pty. Ltd., Australia

[21] Appl. No.: 637,731

[22] PCT Filed: Oct. 28, 1994

[86] PCT No.: PCT/AU94/00656

§ 371 Date: Apr. 28, 1996

§ 102(e) Date: Apr. 28, 1996

[87] PCT Pub. No.: WO95/12038

PCT Pub. Date: May 4, 1995

[30] Foreign Application Priority Data

Oct. 29, 1993 [AU] Australia ..... PM2091

[51] Int. Cl.[6] ..... E02F 3/96

[52] U.S. Cl. ..... 37/468; 37/403; 37/903; 414/723

[58] Field of Search ..... 37/468, 903, 403, 37/404, 410; 414/723, 722, 912; 403/322

[56] References Cited

U.S. PATENT DOCUMENTS

| | | | |
|---|---|---|---|
| 4,439,938 | 4/1984 | Grant | 37/468 X |
| 4,850,789 | 7/1989 | Zimmerman | 414/723 X |
| 4,850,790 | 7/1989 | Johnson et al. | 414/723 |
| 4,881,867 | 11/1989 | Essex et al. | 414/723 |
| 4,984,957 | 1/1991 | Noguchi et al. | 414/723 |
| 5,049,027 | 9/1991 | Morrison et al. | 414/723 |
| 5,088,882 | 2/1992 | Lovitt, Jr. | 414/723 |
| 5,110,254 | 5/1992 | Aubrey | 414/723 |
| 5,310,275 | 5/1994 | Lovitt | 37/468 X |
| 5,332,353 | 7/1994 | Arnold . | |
| 5,456,030 | 10/1995 | Barone et al. | 37/468 |
| 5,529,419 | 6/1996 | Gebauer | 37/468 X |
| 5,546,683 | 8/1996 | Clark | 37/468 |
| 5,549,440 | 8/1996 | Cholakon et al. | 37/468 X |
| 5,584,644 | 12/1996 | Droegemueller | 37/468 X |

FOREIGN PATENT DOCUMENTS

| | | |
|---|---|---|
| 62019/86 | 3/1996 | Australia . |
| 2 631 052 | 11/1989 | France . |
| 88/01322 | 2/1988 | WIPO . |

*Primary Examiner*—Terry Lee Melius
*Assistant Examiner*—Victor Batson
*Attorney, Agent, or Firm*—Burns, Doane, Swecker & Mathis, L.L.P.

[57] ABSTRACT

A quick hitch assembly mountable to a hydraulic arm of heavy duty machinery for hitching an implement having at least one pair of outwardly extending parallel connector brackets. The assembly includes two or more parallel load transmitting plates on a common shaft which are dimensioned to be located parallel to at least one of the bracket pairs. The assembly also includes one or more hook elements for hooking onto the implement, and at least one hydraulically activated ram with a link pin displaceable between a bracket and a plate to form a positive lock between the implement and the assembly.

14 Claims, 5 Drawing Sheets

Fig.1.
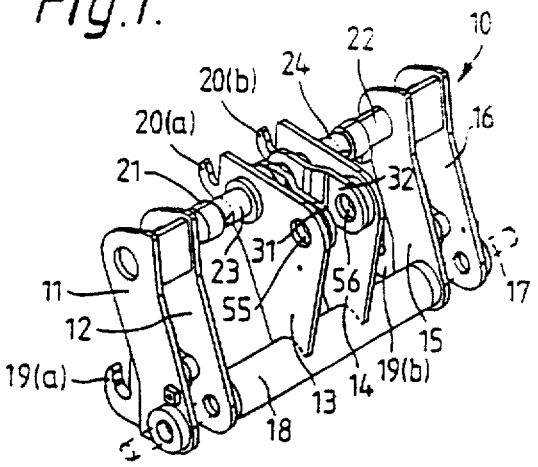
Fig.2.
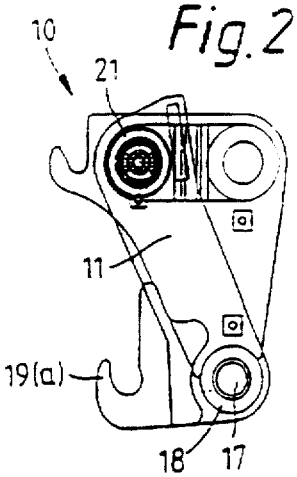
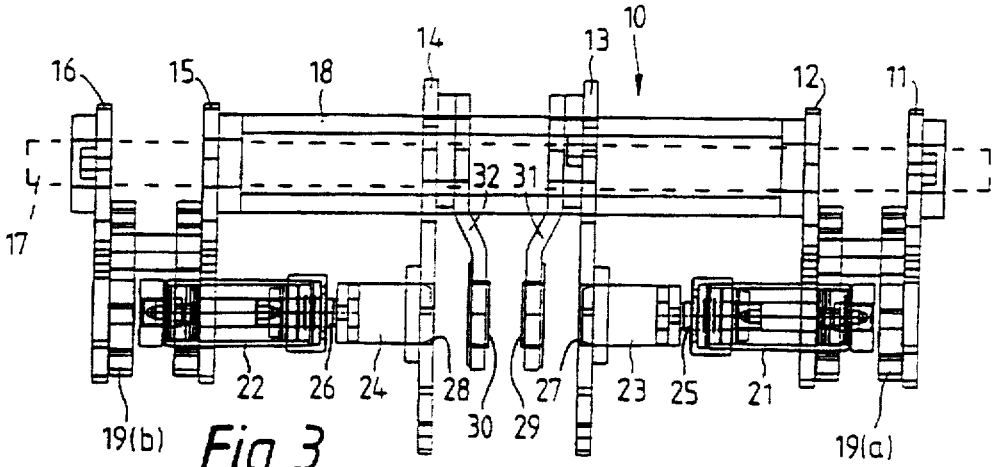
Fig.3.
Fig.4.
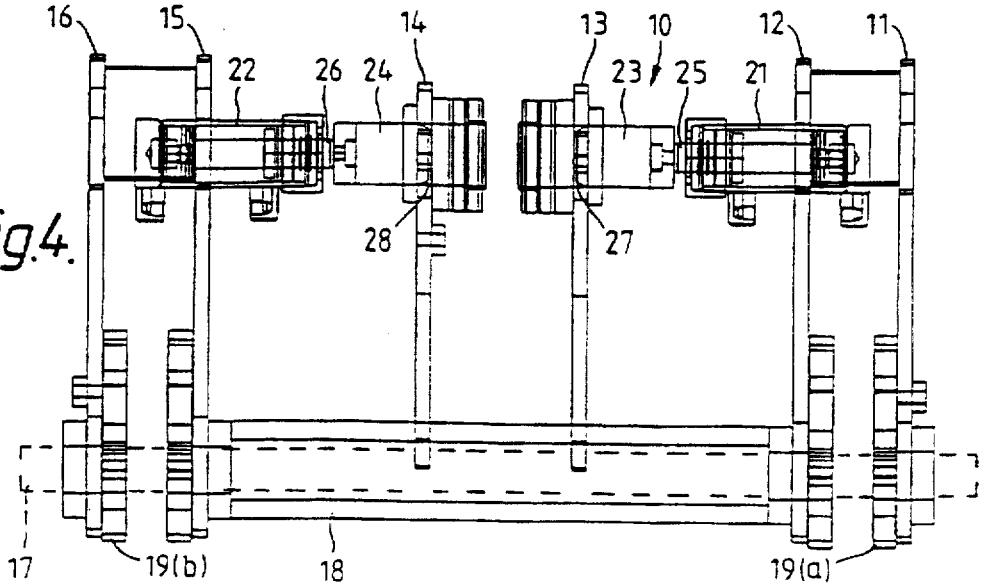

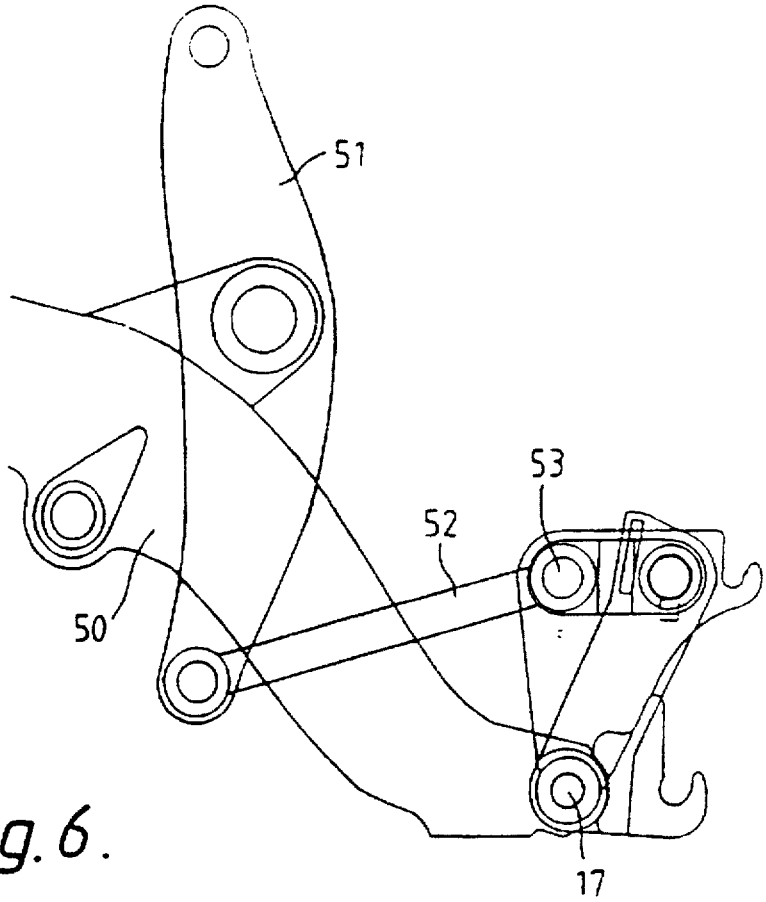
Fig. 6.
Fig. 11.
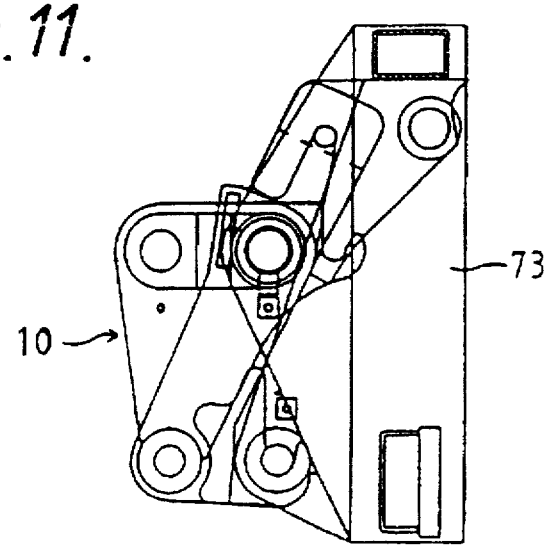

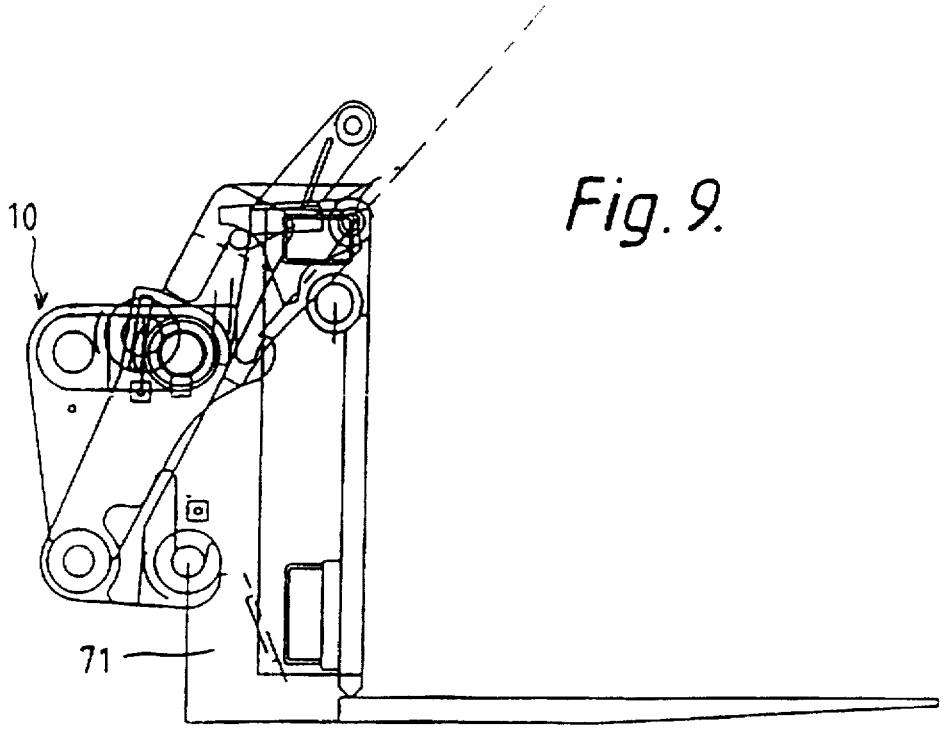
Fig. 9.
Fig. 10.
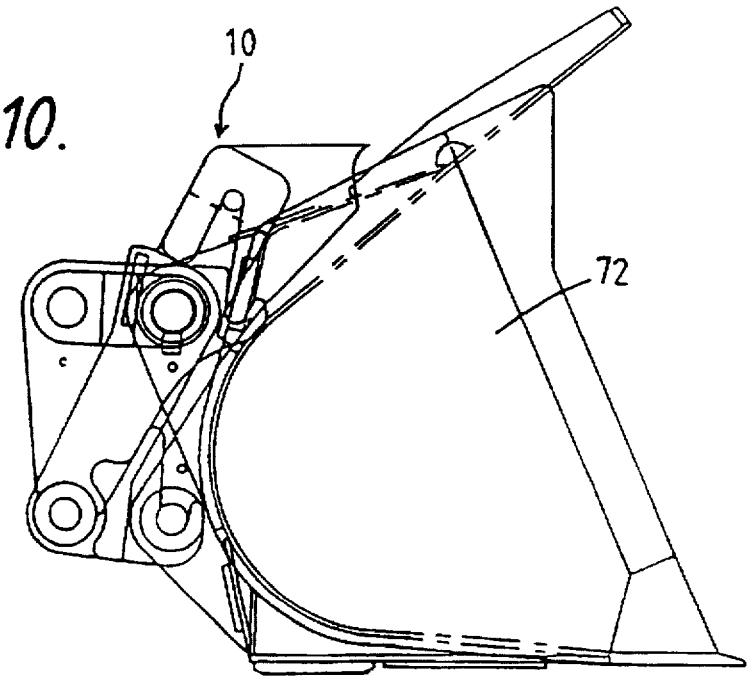

QUICK HITCH ASSEMBLY

TECHNICAL FIELD

THIS INVENTION relates to a hydraulically activated quick hitch assembly for coupling implements to heavy machinery.

BACKGROUND ART

Implements conventionally fitted to heavy machinery include those suitable for loading, working or carrying loads such as a bucket, dipper bucket, fork lift unit, hydraulic shovel, grader or drill unit. Conventionally, the implements are fitted to the heavy machinery by manually inserting large caste steel pins through holes in plates formed on the implements and in the operating arms of the machinery. This is a time consuming and tedious process. The operator must also alight from the controls or employ the services of an assistant.

To rectify this, quick hitch assemblies have been proposed. These assemblies normally enable the connection of the implement to the heavy machinery to be effected automatically by the operator, that is, without the need to alight from the controls of the machinery. None, however, is completely satisfactory for one reason or another. For instance, one common type of quick hitch system requires significant modification of the bucket to enable the quick hitch system to be fitted. Once modified, the bucket cannot then be used by any other front end loader which does not have the same quick fit assembly. More importantly however, modification of the bucket in the first place is a long and costly exercise.

Another quick hitch assembly which has been proposed has a hydraulically activated hook. A significant disadvantage of this hitch is that if the hydraulic pressure drops and/or there is a break in one of the hydraulic lines, the implement may become detached.

It is therefore an object of the present invention to provide a universal quick hitch assembly, which overcomes or at least minimizes the disadvantages of existing quick hitch assemblies, and provides a useful alternative to the public.

DISCLOSURE OF THE INVENTION

According to the present invention, there is provided a quick hitch assembly mountable to a hydraulic arm for hitching an implement having at least one pair of outwardly extending parallel connector brackets, said assembly comprising:

1) at least two parallel load transmitting plates on a common shaft which are dimensioned to locate parallel to at least one of said bracket pairs;

2) one or more hook elements fop hooking onto said implement;

3) at least one hydraulically activated ram with link pin displaceable between one or more of said brackets and one or more of said plates to form a positive lock between said implement and said assembly.

The quick hitch assembly may be used to hitch any type of implement having at least one pair of extending parallel connector brackets.

Such implements include but are not limited to multipurpose buckets, general purpose buckets, fork lifts, graders, hydraulic shovels, rippers or drill units. The quick hitch assembly can be mounted to the hydraulic arm of any type of heavy machinery suitable for operating such implements and includes excavators, back-hoes, bull-dozers, front-end loaders, tractors, graders, and hydraulic shovels.

When the quick hitch assembly is mounted onto a hydraulic arm it can hook onto or pick up the implement by means of the one or more hook elements. When the load transmitting plates are in the desired relative positions with respect to the connector brackets, the link pin or pins can be hydraulically driven home to produce a positive lock therewith between the plate(s) and bracket(s). There is thus no need for the operator to alight from the vehicle or to employ the services of an assistant. The vehicle may be driven up to the implement and the complete hitching can be effected in a matter of minutes. Once hitched, the assembly will stay in place even if there is a leak in the hydraulic system. This may occur if a hydraulic hose is damaged during use. The leak must be repaired before the implement can be released.

The implement is released from the assembly by hydraulically withdrawing the link pins and disengaging the hook elements.

Implements commonly in use with hydraulic machinery have pin holes located in connector brackets. The pin holes are arranged such that two separate pins can be inserted during a conventional mounting operation. Some implements have three pairs of connector brackets. In this case, the pin holes are located to allow one link pin to pass through the centre pair and the other link pin to pass through the outer two bracket pairs. An alternative arrangement has a single pair of connector brackets, each bracket having two pin holes therein.

Typically, the link pin or pins of the quick hitch assembly will pass through one pair of pin holes, thereby attaching the implement to the quick hitch assembly. Only one set of pin holes need be used.

The number of load transmitting plates is typically dependent on the size of the machinery, the implement, the loads and/or use to which the implement will be subjected. For example, two load transmitting plates may be adequate for a quick hitch assembly mountable to a small fork-lift. A typical quick hitch assembly for such a purpose may have two load transmitting plates spaced such that when hitched, they will be located on either side of a pair of centrally located connecting brackets on the implement. A single hydraulic cylinder may be supported by one of the load transmitting plates. This cylinder will activate a ram to drive a single link pin through the pin holes in each of the connecting brackets and through to a pin hole in the opposing load transmitting plate. Alternatively, a hydraulic cylinder may be supported on each of the load transmitting plates. When actuated, each link pin will engage with a single connector bracket. More than two load transmitting plates would generally be required for use with larger implements and heavier loads. The above quick hitch assembly may be modified by having two further load transmitting plates to provide additional support for the link pins. To provide yet further support, each hydraulic cylinder may be supported by a pair of load transmitting plates.

Preferably, the quick hitch assembly has three pairs of load bearing plates. This arrangement is particularly suited for use with implements having three pairs of connector brackets. Preferably, each pair of load transmitting plates will align proximal to a pair of connector brackets. In this preferred arrangement, the quick hitch assembly has two link pins which, during the hitching operation, will be driven through the central pairs of connector brackets and load transmitting plates.

Alternatively, the hydraulic cylinder(s) may be supported on the central load transmitting plates. The link pins would then engage with connector brackets located proximal to the outer pairs of plates. This arrangement would be suitable for implements having only a single pair of connector brackets located near the outer edges of the implement.

The quick hitch assembly hooks onto the implement to hold the implement firmly in place when hitched thereto. The hook element may be a hook bar or two or more separate hooks. The hook elements may hook onto a suitable part of the implement such as a pick-up bar. Alternatively, the hook elements may hook onto a pin mounted through the pin holes of the connector brackets which are not to be engaged by the link pins.

The hook element may also be designed to allow the hitch to pick up loads directly when there is no implement hitched.

Preferably, the quick hitch assembly also includes a guide for guiding the load bearing plates to their proximal positions with respect to the connector bracket.

Supplementary cranked link plates can be located between the central pair of load transmitting plates and inwardly of the central connector brackets when positioned proximal thereto, to provide additional support for the link pins and to additionally act as guides when the implement is in the process of being connected to the quick hitch assembly.

Suitably, further hooking elements are associated with the upper regions of the centrally located load transmitting plates. These hooking elements further assist in the alignment of the plates and brackets so that the pin or pins can be inserted and to this end enable the implement to be raised without tilting while effecting the alignment. Such hooking elements will be adapted to hook around small bars which are welded to the outer facing faces of the central connector brackets, in the upper midregion thereof.

Alternatively, hooking elements may be welded to the implement. These hooking elements will be located so as to engage with small bars associated with the upper regions of the load transmitting plates. Preferably, the bars are associated with the centrally located pair of plates. This arrangement also faciliates alignment during hook-up. The hooking elements on the implement are also relatively easy for the operator to sight during hook-up.

Another minor modification which may be made to the implement is to weld lugs onto the upper facing faces of two of the connector brackets. The lugs are adapted to locate proximal and parallel to a load transmitting plate when hitched. The presence of the lugs assist in alignment during hook up. The upper regions of the load transmitting plates which locate proximal to the modified brackets may also be modified or lengthened to facilitate such alignment.

The quick hitch assembly can be readily fitted to the existing arms of a vehicle using pins and once connected becomes part of the vehicle frame and need not be removed.

The quick hitch assembly operates off the normal hydraulic system of the hydraulic arm to which it is mounted. A directional control valve is suitably built into the hydraulic circuit of the quick hitch assembly. This valve disconnects the hydraulic cylinders from the circuit after the connecting pins have been installed into the bucket pin holes.

BRIEF DESCRIPTION OF THE DRAWINGS

FIG. 1 is a rear perspective view of a quick hitch assemble according to one form of the present invention;

FIG. 2 is an end-on view of the quick hitch assembly depicted in FIG. 1, partly in phantom;

FIG. 3 is a top view of the quick hitch assembly depicted in FIG. 1, partly in phantom;

FIG. 4 is a side-on view of the quick hitch assembly depicted in FIG. 1, partly in phantom;

FIG. 6 is a side perspective view of the quick hitch assembly depicted in FIG. 1, mounted on the arm of a front end loader, FIG. 9 is an end-on view of the quick hitch assembly depicted in FIG. 7 mounted to a fork-lift, FIG. 10 is an end-on view of the quick hitch assembly depicted in FIG. 7 mounted to a general purpose bucket; and FIG. 11 is an end-on view of the quick hitch assembly depicted in FIG. 7 mounted to a grader.

In all the drawings, like reference numerals refer to like parts.

DESCRIPTION OF A PREFERRED EMBODIMENT OF THE INVENTION

Figure 5:
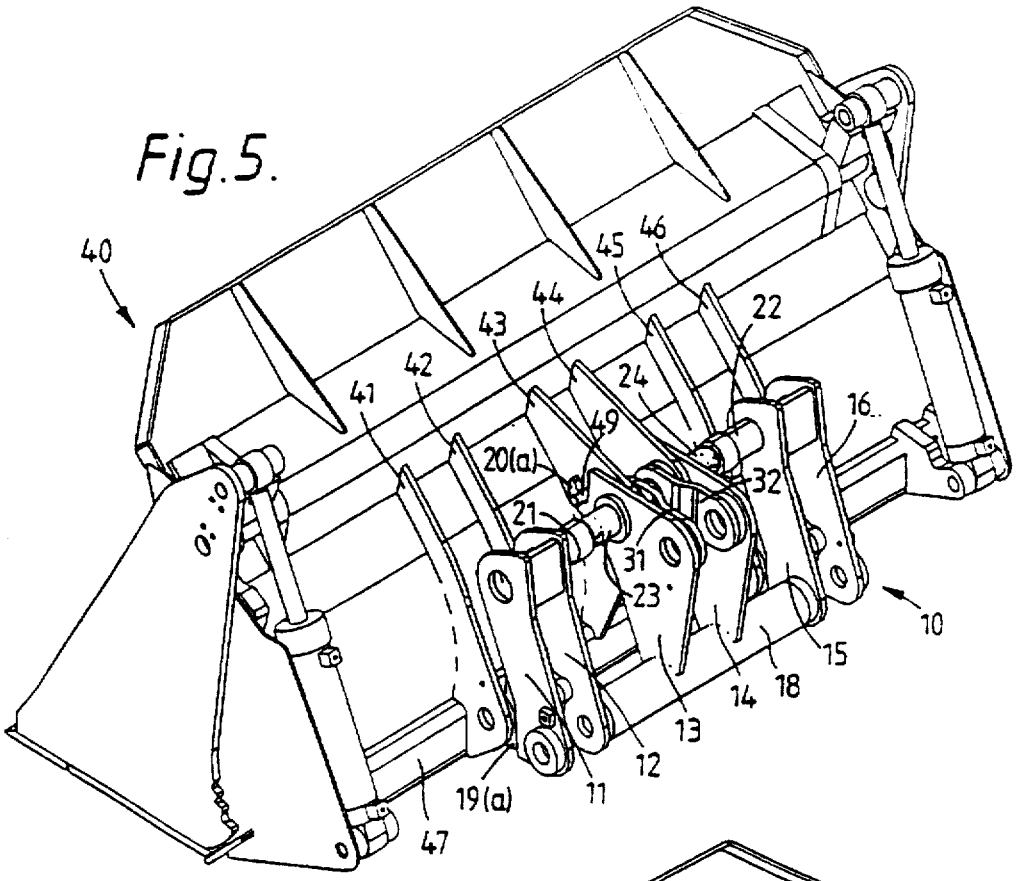
FIG. 5 is a rear perspective view of the quick hitch assembly depicted in FIG. 1, fitted to a bucket for a front end loader.

Referring firstly to FIGS. 1–4, the quick hitch assembly 10 comprises three pairs of load transmitting plates 11, 12; 13, 14 and 15, 16 supported about a common shaft 17 which extends through cylindrical housing 18. Central plates 13, 14 have hooking members 20(*a*), 20(*b*) formed on an upper facing portion thereof and the outer pairs of plates 11, 12 and 15, 16 have an associated hook bump stop 19(*a*), 19(*b*). Hydraulic cylinders 21, 22 are located in the upper regions of load transmitting plates 11, 15 and extend in axial alignment with one another and parallel to shaft 17. Associated link pins 23, 24 are connected to the rams 25, 26 of the hydraulic cylinders, and comprise solid cylindrical castings. The link pins are moveable through circular sheathed openings 27, 28 in the central plates 13, 14 and through circular sheathed openings 29, 30 formed in guide plates 31, 32. The guide plates are cranked away from the walls of the central plates 13, 14 to provide a space into which the central brackets of the bucket can be guided.

FIG. 5 shows the quick hitch assembly 10 connected to a front end loader bucket 40. The loader bucket is of standard design with three pairs of connector brackets 41, 42; 43, 44 and 45, 46 extending outwardly therefrom and parallel to one another. A pick-up bar 47 extends across the bottom of the bucket.

The quick hitch assembly 10 is connected by virtue of the hook bump stops (e.g. see 19(*a*)) supporting the pick-up bar, the pins 23, 24 extending through the load transmitting plates 13, 14 and cranked link plates 31, 32, and the hooking members 20(*a*), 20(*b*) co-acting on pins on the central brackets 43, 44. One of these pins, 49, can be seen in the drawing.

FIG. 6 shows an end-on view of the quick hitch assembly connected to a front end loader. For convenience of description, only one of two sets of connecting arms is shown. The other of the two sets has the same arrangement and is connected in exactly the same manner.

Each set of arms comprises one main load bearing arm 50 and subsidiary arms 51 and 52 pivotally connected thereto, internally of the main arm. Main arm 50 is connected to the quick hitch assembly by way of common shaft 17 and subsidiary arm 52 is connected to a pin 53 which extends through holes in the central pair of load transmitting plates 13, 14 and the guide plates 31, 32. In FIG. 1, reference numeral 55 indicates such a hole in plate 13 and reference numeral 56 indicates such a hole in guide plate 32. The connection is such that once made, the quick hitch assembly need not be removed again.

Figure 7:
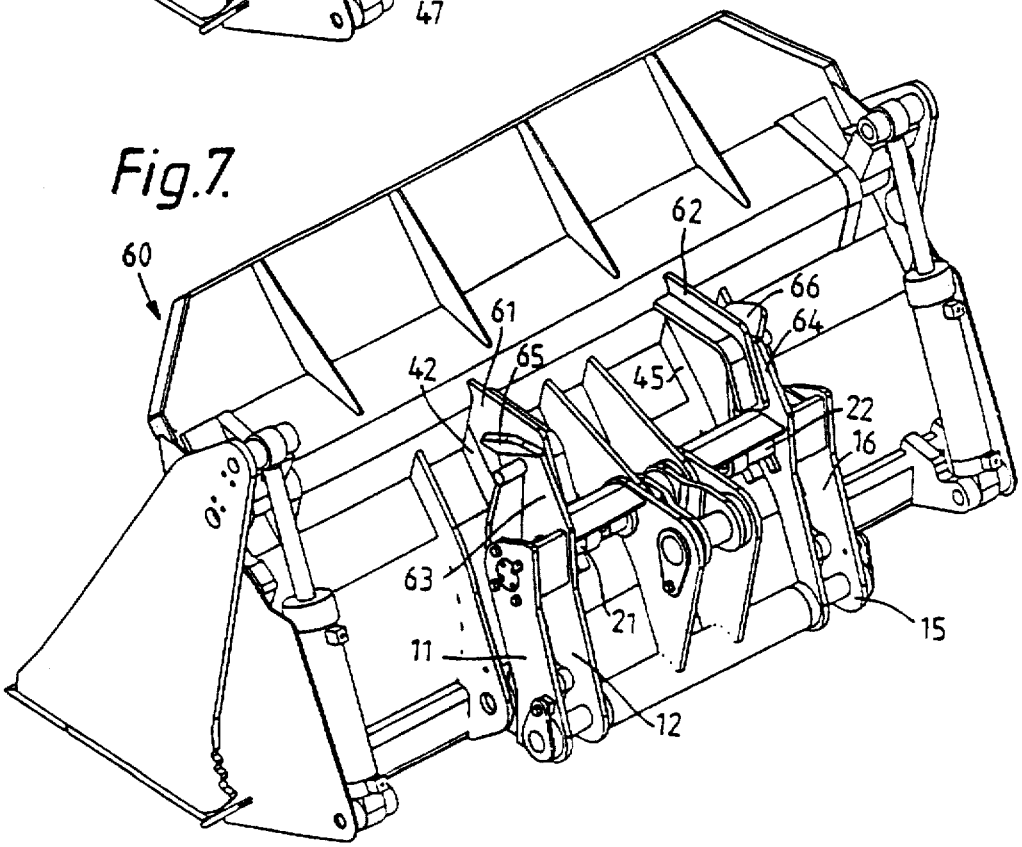
FIG. 7 is a rear perspective view of another form of the quick hitch assembly fitted to a bucket for a front end loader.

FIG. 7 shows a modification of the quick hitch assembly fitted to a front end loader bucket 60. The bucket is identical to that described in FIG. 5. The bucket has ears 61, 62 welded to the upper faces 63, 64 of connector brackets 42, 45. The plates 12, 16 which are proximal to the modified brackets, are longer than the other plates and project above the body of the quick hitch assembly. The tops of the brackets have lugs 65, 66 which are angled away from the assembly body. The lugs and bucket ears assist in alignment during hook up. The hydraulic cylinders 21, 22 are supported by the outermost pairs of plates 11, 12 and 15, 16.

Figure 8A:
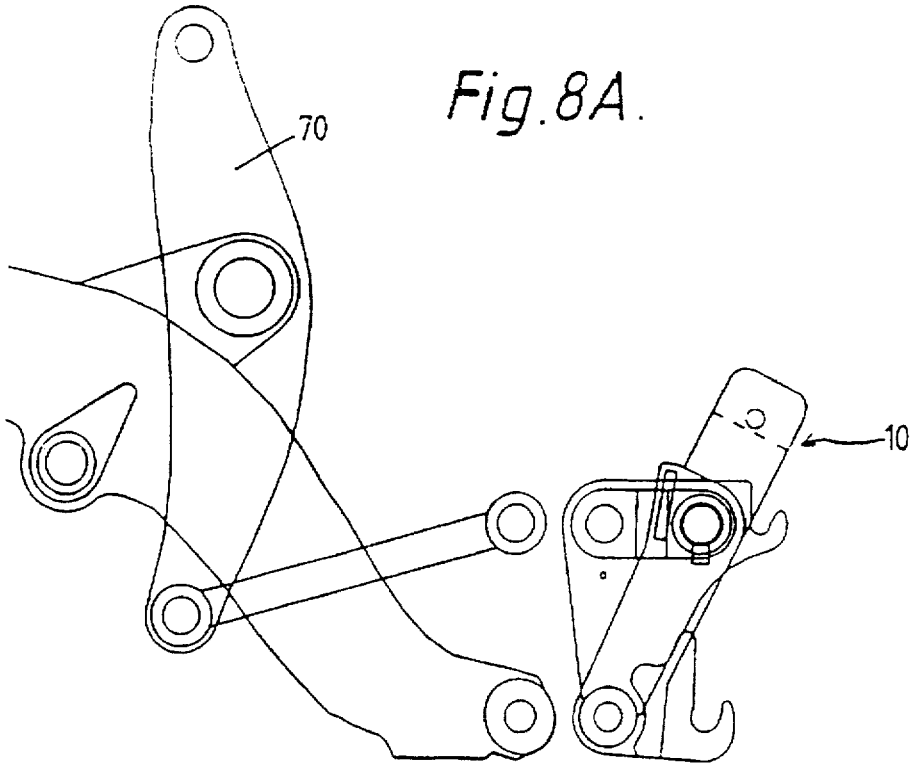
FIG. 8A is an end-on view of the quick hitch assembly depicted in FIG. 7, partly in phantom and the arm of front end loader.
Figure 8B:
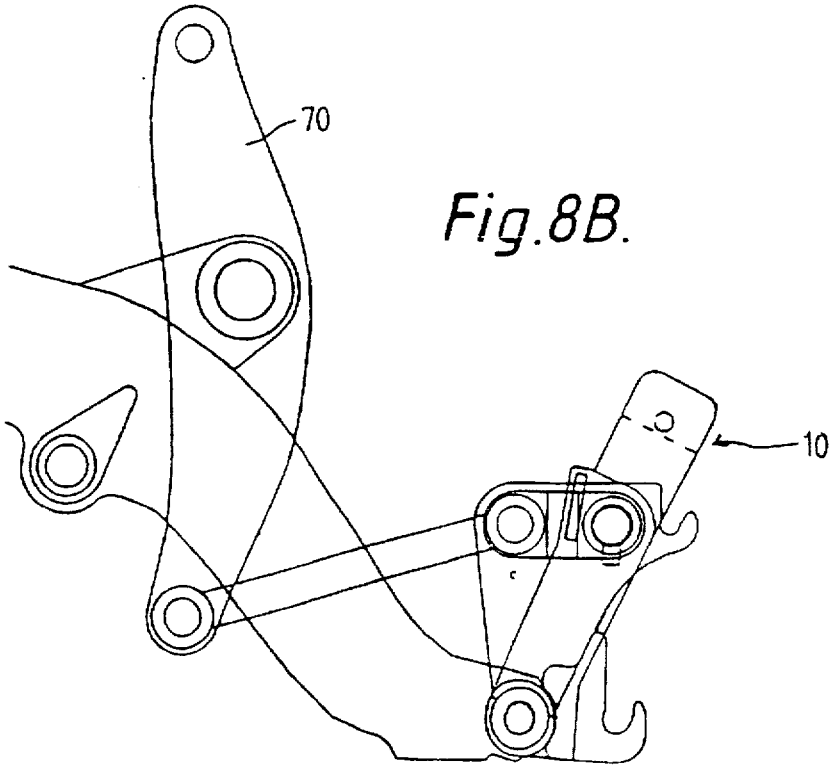
FIG. 8B is a end-on view of the quick hitch assembly depicted in FIG. 8A mounted to the arm of the front-end loader.

FIG. 8A shows an end-on view of the quick hitch assembly depicted in FIG. 7 with a front end loader arm 70 before connection. FIG. 8B shows the quick hitch assembly connected to the loader.

FIG. 9, 10 and 11 show the quick hitch assembly hitched to a fork-lift 71, bucket 72 and grader 73, respectively.

Whilst the above has been given by way of illustrative example of the invention, many modifications and variations may be made thereto by persons skilled in the art without departing from the broad scope and ambit of the invention as herein set forth.

I claim:

1. A quick hitch assembly for attaching a hydraulic arm of heavy duty machinery to an implement having a lower region adapted to be located closest to a ground surface when the implement is attached to the assembly, an upper region, and a plurality of pairs of outwardly extending parallel connector brackets, said quick hitch assembly comprising:

a plurality of pairs of parallel load transmitting plates disposed on a common shaft and dimensioned to be located parallel and proximal to the connector brackets;

a hook element for engaging the lower region of the implement;

means for engaging said assembly with the upper region of the implement;

a guide for guiding said load transmitting plates to a proximal position with respect to the connector brackets; and at least one hydraulically activated ram provided with a link pin that is displaceable to form a positive lock between the implement and the assembly when the implement is engaged by the hook element and the means for engaging.

2. An assembly according to claim 1, wherein the means for engaging said assembly with the upper region of the implement is a hook element located on said assembly.

3. An assembly according to claim 1, wherein the means for engaging said assembly with the upper region of the implement is a bar located on said assembly.

4. An assembly according to claim 1, including two link pins each activated by a respective hydraulic cylinder with a common axis, each cylinder being supported by an outer pair of the load transmitting plates.

5. An assembly according to claim 4, including a pair of rams each provided with a respective displaceable link pin, the respective link pins being displaceable through holes in a central pair of the connector brackets when the rams are activated.

6. An assembly as claimed in claim 5, wherein said guide comprises a pair of cranked plates adapted to be located between a pair of the connector brackets.

7. An assembly as claimed in claim 6, wherein said cranked plates are adapted to be located between a central pair of the brackets and have pin holes adapted to be located coaxially with pin holes in the pair of central brackets for receiving said link pins.

8. An apparatus as claimed in claim 1, having a hydraulic circuit operable off a hydraulic system of the hydraulic arm.

9. An apparatus as claimed in claim 8, wherein the plurality of pairs of load transmitting plates includes three pairs of load transmitting plates.

10. A hydraulic arm for a heavy machinery vehicle having the assembly as claimed in claim 1 mounted thereto.

11. A method of automatically hitching a hydraulic arm to an implement having a plurality of pairs of outwardly extending parallel connecting brackets, a lower region adapted to be located closest to a ground surface when the implement is being attached to the arm, and an upper region, said method including the steps of:

mounting to the hydraulic arm a quick hitch assembly having a plurality of pairs of parallel load transmitting plates and at least one hydraulically actuated ram provided with a link pin;

aligning a first hook element of said assembly with said upper region of said implement;

aligning a second hook element of said assembly with said lower region of said implement;

engaging said first and second hook elements with said implement such that said connector brackets are aligned with respective ones of said load transmitting plates;

hydraulically activating said at least one hydraulically actuated ram to displace said link pin relative to one of said connector brackets to form a positive lock between said implement and said assembly.

12. A quick hitch assembly for attaching a hydraulic arm of heavy duty machinery to an implement having a lower region adapted to be located closest to a ground surface when the implement is being attached to said assembly, an upper region, and at least one pair of outwardly extending parallel connector brackets, said assembly comprising:

at least two parallel load transmitting plates on a common shaft which are dimensioned to be located parallel to the connector bracket;

a hook element for engaging the lower region of the implement;

means for engaging the assembly to the upper region of the implement; and at least one hydraulically activated ram provided with a link pin that is adapted to be displaced between one of the brackets and one of the load transmitting plates to form a positive lock between the implement and the assembly when the implement is engaged by the hook element and the means for engaging.

13. An assembly according to claim 12, wherein said at least two load transmitting plates includes three pairs of load transmitting plates dimensioned to be located parallel and proximal to three pairs of connector brackets.

14. An assembly according to claim 13, further comprising a guide for guiding said load transmitting plates to proximal positions with respect to the brackets.

* * * * *